US006763115B1

(12) United States Patent
Kobayashi

(10) Patent No.: US 6,763,115 B1
(45) Date of Patent: Jul. 13, 2004

(54) PROCESSING METHOD FOR LOCALIZATION OF ACOUSTIC IMAGE FOR AUDIO SIGNALS FOR THE LEFT AND RIGHT EARS

(75) Inventor: Wataru Kobayashi, Tokyo (JP)

(73) Assignees: OpenHeart Ltd., Tokyo (JP); A Limited Responsibility Company, Research Network, Kyoto (JP)

( * ) Notice: Subject to any disclaimer, the term of this patent is extended or adjusted under 35 U.S.C. 154(b) by 0 days.

(21) Appl. No.: 09/360,456

(22) Filed: Jul. 26, 1999

(30) Foreign Application Priority Data

Jul. 30, 1998 (JP) ..... 10-228520

(51) Int. Cl.[7] ..... H04R 5/02; H04R 5/00
(52) U.S. Cl. ..... 381/309; 381/17; 381/310
(58) Field of Search ..... 381/1, 17, 18, 381/19, 309, 310, 99, 74, 26

(56) References Cited

U.S. PATENT DOCUMENTS 4,218,585 A 8/1980 Carver
5,278,909 A * 1/1994 Edgar ..... 381/17
5,305,386 A * 4/1994 Yamato ..... 381/1
5,500,900 A * 3/1996 Chen et al. ..... 381/17
5,579,396 A 11/1996 Iida et al.
5,657,391 A 8/1997 Jyosako
5,809,149 A * 9/1998 Cashion et al. ..... 381/17
6,009,179 A * 12/1999 Wood et al. ..... 381/17
6,021,205 A * 2/2000 Yamada et al. ..... 381/310
6,108,430 A * 8/2000 Kurisu ..... 381/310

* cited by examiner

*Primary Examiner*—Xu Mei
(74) *Attorney, Agent, or Firm*—Duane Morris LLP

(57) ABSTRACT

In views of a disadvantage that in a conventional method for localization of sound image in stereo listening, the amount of software is increased and the scale of hardware is enlarged, this invention has been achieved to solve such a problem and intends to provide a processing method for audio signal to be inputted from an appropriate sound source capable of higher precision localization of sound image than the conventional method. When a sound generated from an appropriate sound source SS is processed as an audio signal in the order of inputs on time series, the inputted audio signal is transformed into audio signals for the left and right ears of a person and further each of the audio signals is divided to at least two frequency bands. Then, the divided audio signal of each band is subjected to a processing for controlling an element for a feeling of the direction of a sound source SS and an element for a feeling of the distance up to that sound source, which are appealed to person's auditory sense and outputting the processed audio signal.

7 Claims, 1 Drawing Sheet

Figure 1:
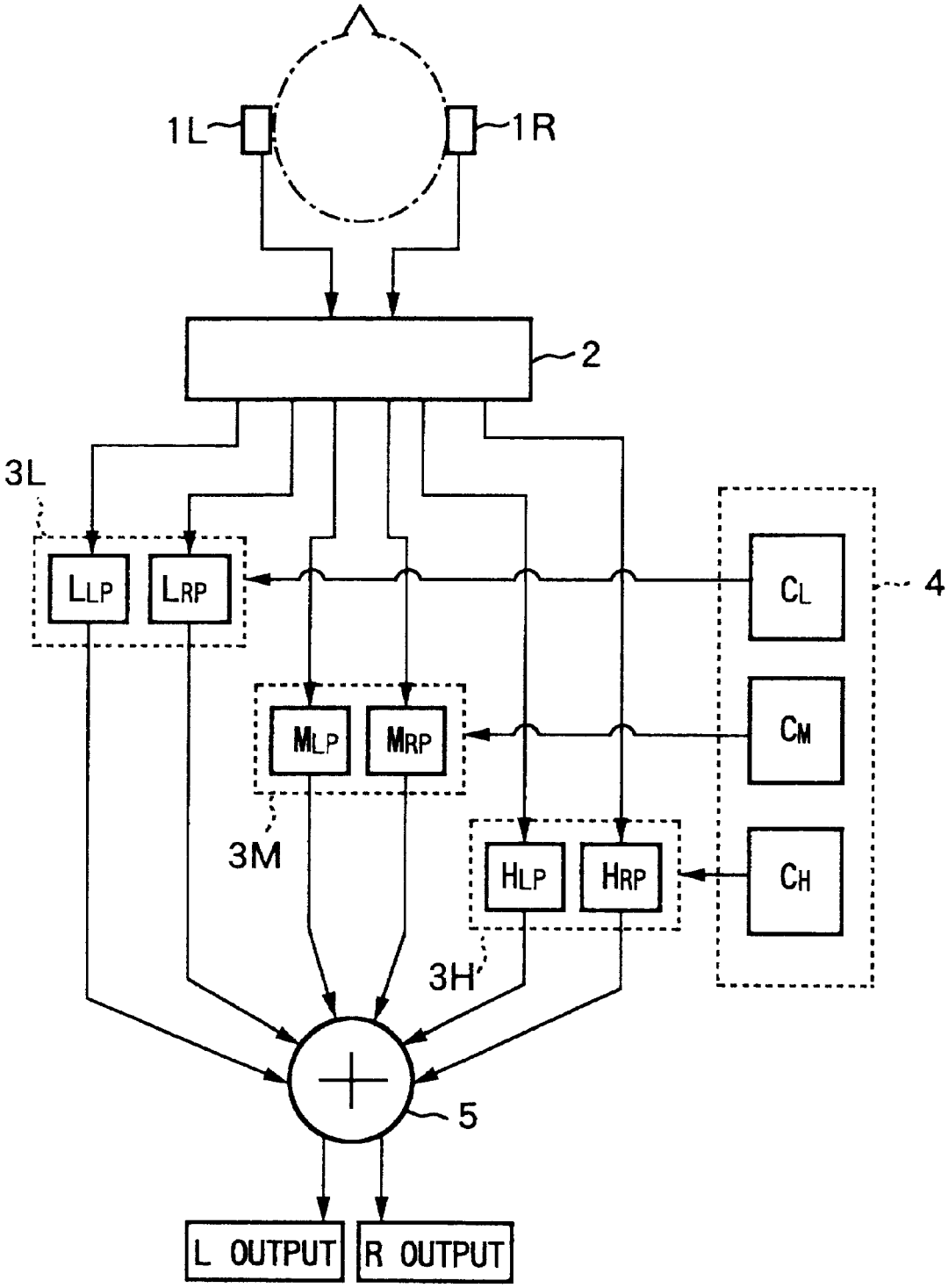

PROCESSING METHOD FOR LOCALIZATION OF ACOUSTIC IMAGE FOR AUDIO SIGNALS FOR THE LEFT AND RIGHT EARS

BACKGROUND OF THE INVENTION

1. Field of the Invention

The present invention relates to a processing method for input audio signals, not only enabling a listener to obtain a feeling that he is located at an actual acoustic space actually containing a sound source or a feeling of localization of acoustic image even if he is not located at the actual acoustic space containing the sound source when he listens to a music with both the ears through ear receivers such as stereo ear phones, stereo head phones and various kinds of stand-alone type speakers, but also capable of realizing a precise localization of acoustic sound which has not been obtained with a conventional method.

2. Description of the Related Art

As a method for localization of acoustic image in, for example, listening to stereo music, conventionally, various methods have been proposed or tried. Recently, the following methods have been also proposed.

Generally it has been said that human being senses a location of a sound which he listens to or locations of up, down, left, right, front and rear with respect to a sound source relative to him by hearing the sound with his both ears. Therefore, it is theoretically considered that for a listener to hear a sound as if it comes from an actual sound source, by reproducing any input audio signal by real-time overlapping computation with a predetermined transmission function, that sound source can be localized in human hearing sense by the reproduced sounds.

According to the above described sound image localization system in the stereo listening, a transmission function for obtaining a localization of sound image outside the human head in auditory sense as if a person hears at an actual place containing a sound source is produced according to a formula indicating output electric information of a small microphone for inputting a pseudo sound source and a formula indicating an output signal of an ear phone. Any input audio signal is subjected to overlapping computation with this transmission function and reproduced, so that a sound from the sound source inputted at any place can be localized in auditory sense by reproduced sounds for stereo listening. However, this system has a disadvantage that the amount of software for computation processing and the scale of hardware will be enlarged.

SUMMARY OF THE INVENTION

Accordingly, in views of such a disadvantage that in the above conventional method for localization of sound image in stereo listening, the amount of software is increased and the scale of hardware is enlarged, the present invention has been achieved to solve such a problem, and therefore, it is an object of the present invention to provide a processing method for audio signal to be inputted from an appropriate sound source capable of higher precision localization of sound image than the conventional method.

To achieve the above object, according to an aspect of the present invention, there is provided a processing method for localization of sound image for audio signals for the left and right ears comprising, when a sound generated from an appropriate sound source is processed as an audio signal in the order of inputs on time series, the steps of: transforming the inputted audio signal to audio signals for the left and right ears of a person; dividing each of the audio signals to at least two frequency bands; and subjecting the divided audio signal of each band to a processing for controlling an element for a feeling of the direction of the sound source to be applied on person's auditory sense and an element for a feeling of the distance up to the sound source and outputting the processed audio signal.

In the present invention, the element for a feeling of the direction of the sound source to be controlled is a difference of time of audio signals for the left and right ears, a difference of sound volume or the differences of time and sound volume. The element for a feeling of the distance up to- the sound source to be controlled is a difference of sound volume of audio signals for the left and right ears, a difference of time or the differences of sound volume and time.

Further according to another aspect of the present invention, there is provided a processing method for localization of sound image for the audio signal for the left and right ears comprising the steps of: dividing an audio acoustic signal inputted appropriately from a sound source to sounds for the left and right ears of a person; dividing the audio inputted signal of each ear to such frequency bands as low/medium range and high range, low range and medium/high range or low range, medium range and high range; and processing the audio signals for the left and right ears while the medium range band being subjected to a control based on simulation by a head portion transmission function of frequency characteristic, the low range band being subjected to a control with a difference of time or a difference of time and difference of sound volume as parameters, and the high range band being subjected to a control with a difference of sound volume or a difference of sound volume and the difference of time taken for combfilter processing as parameters.

BRIEF DESCRIPTION OF THE ACCOMPANYING DRAWING

FIG. 1 is a functional block diagram showing an example for carrying out a method of the present invention.

DESCRIPTION OF THE PREFERRED EMBODIMENTS

The embodiments of the present invention will be described in detail with the accompanying drawings.

According to a prior art, various methods have been used so as to obtain a localization of sound image in hearing a reproduced sound with both the left and right ears. An object of the present invention is to process input audio signals so as to achieve a highly precise localization of sound image as compared to the conventional method when an actual sound is recorded through, for example, a microphone (available in stereo or monaural), even if the hardware or software configuration of the control system is not so large.

Therefore, according to the present invention, the audio signal input from a sound source is divided to, for example, three bands, that is, low, medium and high frequencies and then the audio signal of each band is subjected to processing for controlling its sound image localizing element. This processing is made assuming that a person is actually located with respect to any actual sound source and intends to process the input audio signal so that sounds transmitted from that sound source becomes a real sound when they actually come into both the ears. According to the present invention, dividing the input audio signal to bands is not restricted to the above example, but a sound may be divided to two ranges or four or more ranges such as medium/low range and high range, low range and medium/high range, low range/high range and further detailed ranges.

Conventionally, it has been known that when a person hears any actual sound with both his ears, localization of sound image is affected by such physical elements as his head, the ears provided on both sides of his head, transmission structure of a sound in both the ears and the like. Thus, according to the present invention, a processing for controlling the input audio signal is carried out based on the following method.

First, if the head of a person is regarded as a sphere having a diameter of about 150–200 mm although there is a personal difference therein, in a frequency (hereinafter referred to as aHz) below a frequency whose half wave length is this diameter, that half wave length exceeds the diameter of the above spheres and therefore, it is estimated that a sound of a frequency below the above aHz is hardly affected by the head portion of a person. Then, the input audio signal below the aHz is processed based on the above estimation. That is, in sounds below the above aHz, reflection and refraction of sound by the person's head are substantially neglected and they are controlled with a difference in time of sounds entering into both the ears from a sound source and sound volume at that time as parameters, so as to achieve localization of sound image.

On the other hand, if the concha is regarded as a cone and the diameter of its bottom face is assumed to be substantially 35–55 mm, it is estimated that a sound having a frequency larger than a frequency (hereinafter referred to as bHz) whose half wave length exceeds the diameter of the aforementioned concha is hardly affected by the concha as a physical element. Based thereon, the input audio signal below the aforementioned bHz is processed. An inventor of the present invention measured acoustic characteristic in a frequency band more than the aforementioned bHz using a dummy head. As a result, it was confirmed that that characteristic resembled the acoustic characteristic of a sound passed through a combfilter.

From these matters, it has been known that the acoustic characteristics of different elements have to be considered in a frequency band around the aforementioned bHz. As for localization of sound image about a frequency band more than the aforementioned bHz, it has been concluded that the localization of sound image can be achieved about the input audio signal in this band by subjecting that audio signal to a processing by passing through the combfilter and then controlling that signal with the difference of time in sound entry into both the ears and sound volume as parameters.

In a narrow band of from aHz to bHz left in others than the above considered bands, it has been confirmed that if the input audio signal is controlled by simulating the frequency characteristic by reflection and refraction due to the head or concha as physical elements according to a conventional method, the sounds in this band can be processed and based on this knowledge, the present invention has been achieved.

According to the above knowledge, a test regarding localization of sound image was carried out about each band of less than aHz in frequency, above bHz and a range between aHz and bHz with such control elements as a difference of time of sound entering into the both ears and sound volume as parameters and as a result, the following result was obtained. Result of a test on a band less than aHz Although about the audio signal of this band, some extent of localization of sound image is possible only by controlling two parameters, namely, a difference of time of a sound entering into the left and right ears and sound volume, a localization in any space containing vertical direction cannot be achieved sufficiently by controlling these elements alone. A position for localization of sound image in horizontal plane, vertical plane and distance can be achieved arbitrarily by controlling a difference of time between the left and right ears in the unit of $1/10^{-5}$ seconds and a sound volume in the unit of ndB (n is a natural number of one or two digits). Meanwhile, if the difference of time between the left and right ears is further increased, the position for localization of a sound image is placed in the back of a listener.

Result of a Test on a Band Between aHz and bHz

Influence of Difference of Time

With a parametric equalizer (hereinafter referred to as PEQ) invalidated, a control for providing sounds entering into the left and right ears with a difference of time was carried out. As a result, no localization of a sound image was obtained unlike a control in a band less than the aforementioned aHz. Additionally, by this control, it was known that the sound image in this band was moved linearly.

In case for processing the input audio signals through the PEQ, a control with a difference of time of sounds entering into the left and right ears as a parameter is important. Here, the acoustic characteristic which can be corrected by the PEQ is three kinds including fc (central frequency), Q (sharpness) and Gain (gain).

Influence of Difference of Sound Volume

If the difference of sound volume with respect to the left and right ears is controlled around the ndB (n is a natural number of one digit), a distance for localization of a sound image is extended. As the difference of sound volume increases, the distance for localization of the sound image shortens.

Influence of Fc

When a sound source is placed at an angle of 45 degrees forward of a listener and an audio signal entering from that sound source is subjected to PEQ processing according to the listener's head transmission function, it has been known that if the fc of this band is shifted to a higher side, the distance for sound image localizing position tends to be prolonged. Conversely, it has been known that if the fc is shifted to a lower side, the distance for the sound image localizing position tends to be shortened.

Influence of Q

When the audio signal of this band is subjected to the PEQ processing under the same condition as in case of the aforementioned fc, if Q near 1 kHz of the audio signal for the right ear is increased up to about four times relative to its original value, the horizontal angle is decreased but the distance is increased while the vertical angle is not changed. As a result, it is possible to localize a sound image forward in a range of about 1 m in a band from aHz to bHz.

When the PEQ Gain is minus, if the Q to be corrected is increased, the sound image is expanded and the distance is shortened.

Influence of Gain

When the PEQ processing is carried out under the same condition as in the above influences of fc and Q, if the Gain at a peak portion near 1 kHz of the audio signal for the right ear is lowered by several dB, the horizontal angle becomes smaller than 45 degrees while the distance is increased. As a result, almost the same sound image localization position as when the Q was increased in the above example was realized. Meanwhile, if a processing for obtaining the effects of Q and Gain at the same time is carried out by the PEQ, there is no change in the distance for the sound image localization produced.

Result of a Test on a Band Above bHz

Influence of Difference of Time

By only a control based on the difference of time of sound entering into the left and right ears, localization of sound image could be hardly achieved. However, a control for providing with a difference of time to the left and right ears after the combfilter processing was carried out was effective for the localization of the sound image.

It has been known that if the audio signal in this band is provided with a difference of sound volume with respect to the left and right ears, that influence was very effective as compared to the other bands. That is, for a sound within this band to be localized in terms of sound image, a control capable of providing the left and right ears with a difference of sound volume of some extent level, for example, more than 10 dB is necessary.

Influence of Combfilter Gap

As a result of making tests by changing a gap of the combfilter, the position for localization of the sound image was changed noticeably. Further, when the gap of the combfilter was changed about a single channel for the right ear or left ear, the sound image at the left and right sides was separated in this case and it was difficult to sense the localization of the sound image. Therefore, the gap of the combfilter has to be changed at the same time for both the channels for the left and right ears.

Influence of the Depth of the Combfilter

A relation between the depth and vertical angle has a characteristic which is inverse between the left and right.

A relation between the depth and horizontal angle also has a characteristic which is inverse between the left and right.

It has been known that the depth is proportional to the distance for localization of a sound volume.

Result of a Test in Crossover Band

There was no discontinuity or feeling about antiphase in a band below aHz, an intermediate range of aHz-bHz and a crossover portion between this intermediate band and a band above bHz. Then, a frequency characteristic in which the three bands are mixed is almost flat.

As a result of the above tests, there was obtained a result indicating that localization of sound image can be controlled by different elements in multiplicity of divided frequency bands of an input audio signal for the left and right ears. That is, an influence of the difference of time of a sound entering into the left and right ears upon the localization of sound image is considerable in a band below aHz and the influence of the difference of time is thin in a high band above bHz. Further, it has been made apparent that in a high range above bHz, use of the combfilter and providing the left and right ears with a difference of sound volume are effective for localization of sound image. Further, in the intermediate range of aHz to bHz, other parameters for localization forward although the distance was short than the aforementioned control element were found out.

Next, an embodiment of the present invention will be described with reference to FIG. 1. In this Figure, SS denotes any sound source and this sound source may be a single source or composed of multiplicity thereof. 1L and 1R denote microphones for the left and right ears and this microphones 1L, 1R may be either stereo microphones or monaural microphones.

Although in case where the microphone for a sound source SS is a single monaural microphone, a divider for dividing an audio signal inputted from that microphone to each audio signal for the left and right ears is inserted in the back of that microphone, in an example shown in FIG. 1, the divider does not have to be used because the microphones for the left ear 1L and right ear 1R are used.

Reference numeral 2 denotes a band dividing filter which is connected to the rear of the aforementioned microphones 1L, 1R. In this example, the band dividing filter divides the input audio signal to three bands, that is, a low range of less than about 1000 Hz, an intermediate range of about 1000 to about 4,000 Hz and a high range of more than about 4,000 Hz for each channel of the left and right ears and outputs it. According to the present invention, the number of the divided bands of an audio signal to be inputted from the microphones 1L, 1R is arbitrary if it is over 2.

Reference numerals 3L, 3M, 3H denote signal processing portions for the audio signal of each band in the two left and right channels divided by the aforementioned filter 2. Here, low range processing portions LLP, LRP, intermediate processing portions MLP, MRP and high range processing portions HLP, HRP are formed for the left and right channels each.

Reference numeral 4 denotes a control portion for providing the audio signals of the left and right channels in each band processed by the aforementioned signal processing portion 3 with a control for localization of sound image. In the example shown here, by using three control portions CL, CM and CH for each band, a control processing with the difference of time with respect to the left and right ears and sound volume described previously as parameters is applied to each of the left and right channels in each band. In the above example, it is assumed that at least the control portion CH of the signal processing portion 3H for the high range is provided with a function for giving a coefficient for making this processing portion 3H act as the combfilter.

Reference numeral 5 denotes a mixer for synthesizing controlled audio signals outputted from the control portion 4 of each band in each channels for the left and right ears through the crossover filter. In this mixer 5, L output and R output of output audio signals for the left and right ears controlled in each band are supplied to left and right speakers through an ordinary audio amplifier (not shown), so as to reproduce playback sound clear in localization of sound image.

The present invention has been described above. Although according to a conventional method for localization of sound image, an audio signal inputted from a monaural or stereo microphones is reproduced for the left and right ears and a control processing is carried out on a signal reproduced by using the head portion transmission function so as to localize a sound image outside the head at the time of listening in stereo, according to the present invention, the audio signal inputted from the microphone is divided to the channels for the left and right ears and as an example, and the audio signal of each channel is divided to three bands including low, medium and high ranges. Then, the audio signal is subjected to control processing with such sound image localizing element as a difference of time with respect to the left and right ears and sound volume as parameters so as to form input audio signals for the left and right ears inputted appropriately from a sound source. As a result, even if no control processing for sound image localization which is carried out conventionally for sound reproduction is carried out for the sound reproduction, a playback sound excellent in localization of sound image can be obtained. Further, if the control for localization of sound image is overlapped on the aforementioned conventional method upon sound reproduction, a further effective or more precise sound image localization can be achieved easily.

What is claimed is:

1. A processing method for localization of a sound image for audio signals for the left and right ears comprising, when a sound generated from an appropriate sound source is processed as an audio signal in the order of inputs on time series, the steps of:

transforming the inputted audio signal to audio signals for the left and right ears of a person;

dividing each of the audio signals into frequency bands selected from the group comprising: a low/medium range and high range; a low range and medium/high range; and a low range, medium range and high range, wherein the low range band is a frequency band of less than aHz having a half wave length corresponding to a diameter of a head of a person, the high range band is a frequency band of more than bHz having a half wave length corresponding to a diameter of a concha of a person, and the medium range band is a frequency band between aHz and bHz; and subjecting the divided audio signal of each band to a processing for controlling an element for a feeling of the direction of the sound source to be applied on a person's auditory sense and an element for a feeling of the distance up to the sound source and outputting the processed audio signal.

2. A processing method for localization of a sound image for audio signals for the left and right ears according to claim 1 wherein the element for a feeling of the direction of the sound source to be controlled is a difference of time or a difference of sound volume with respect to the left and right ears of the audio signal or the difference of time and difference of sound volume.

3. A processing method for localization of a sound image for audio signals for the left and right ears according to claim 1 wherein the element for a feeling of the distance up to the sound source to be controlled is a difference of sound volume or a difference of time with respect to the left and right ears of the audio signal or the difference of sound volume and the difference of time.

4. A processing method for localization of a sound image for an audio signal for the left and right ears comprising the steps of:

dividing an audio acoustic signal inputted appropriately from a sound source to sounds for the left and right ears of a person;

dividing the audio inputted signal of each ear to such frequency bands as low/medium range and high range, low range and medium/high range or low range, medium range and high range; and processing the audio signals for the left and right ears while the medium range band is subjected to a control based on a simulation by a head portion transmission function of a frequency characteristic, the low range band is subjected to a control with a difference of time or a difference of time and a difference of sound volume as parameters, and the high range band is subjected to a control with a difference of sound volume or a difference of sound volume and difference of time taken by combfilter processing as parameters.

5. A processing method for localization of a sound image for the audio signal for the left and right ears according to claim 4 wherein the medium range band is about 1,000–4,000 Hz.

6. A processing method for localization of a sound image for the audio signal for the left and right ears according to claim 4 wherein the low range band is a band of less than about 1,000 Hz.

7. A processing method for localization of a sound image for the audio signal for the left and right ears according to claim 4 wherein the high range band is a band of above about 4,000 Hz.

* * * * *